US007455296B2

(12) United States Patent
Johannson

(10) Patent No.: US 7,455,296 B2
(45) Date of Patent: Nov. 25, 2008

(54) PLAY FIGURE

(76) Inventor: Oliver Johannson, Liebigstrasse 67, Darmstadt (DE) 64293

( * ) Notice: Subject to any disclaimer, the term of this patent is extended or adjusted under 35 U.S.C. 154(b) by 27 days.

(21) Appl. No.: 11/117,476

(22) Filed: Apr. 29, 2005

(65) Prior Publication Data

US 2006/0082054 A1 Apr. 20, 2006

(30) Foreign Application Priority Data

Oct. 19, 2004 (DE) ..... 10 2004 050 780

(51) Int. Cl.
*A63B 67/14* (2006.01)

(52) U.S. Cl. ..... 273/108; 273/108.22; 446/354; 446/376

(58) Field of Classification Search ..... 446/268–395; 124/4, 6, 79; 273/108.22
See application file for complete search history.

(56) References Cited

U.S. PATENT DOCUMENTS

| | | | | | |
|---|---|---|---|---|---|
| 1,409,612 | A * | 3/1922 | Stout | 273/108.22 |
| 2,222,499 | A * | 11/1940 | Byrd | 273/108.22 |
| 2,477,308 | A * | 7/1949 | Malkan | 124/79 |
| 2,513,198 | A * | 6/1950 | Munro | 273/108.22 |
| 2,638,348 | A * | 5/1953 | Arenson et al. | 273/108.22 |
| 2,960,796 | A * | 11/1960 | Woodrey | 446/358 |
| 3,458,195 | A * | 7/1969 | Neubeck | 273/108.22 |
| 4,279,419 | A * | 7/1981 | Barnes et al. | 273/108.22 |
| 4,448,418 | A * | 5/1984 | McNeill | 273/123 A |
| 5,449,171 | A * | 9/1995 | Makhoulian | 273/108.22 |
| 6,280,285 | B1 | 8/2001 | Morehouse | |
| 6,439,952 | B1 * | 8/2002 | Yamamura | 446/383 |

FOREIGN PATENT DOCUMENTS

| | | |
|---|---|---|
| DE | 378 192 C | 7/1923 |
| DE | 76 04 836 U | 10/1976 |
| DE | 297 15 450 U | 12/1997 |
| DE | 19807334 | 9/1999 |
| DE | 82 28 505 U | 3/2003 |
| GB | 2256 592 A | 12/1992 |
| WO | WO9214523 | 9/1992 |

* cited by examiner

*Primary Examiner*—Nini Legesse
(74) *Attorney, Agent, or Firm*—Jacobson Holman PLLC

(57) ABSTRACT

A toy figure in the form of a golf player with a body including a head, torso, arms and legs. A recess is provided in the body. The arms and the connected hands have a receptacle for the golf club. The golf club is swivelable through actuation of an operating handle or pin. In order to improve the function and the appearance of a toy figure, the recess defines a plane, which extends through the body downward and parallel to the operating handle or pin and the arms. A toothed disc is fixed in the recess and rotatably connected with the arms. The toothed disc is coupled with the operating handle or pin.

16 Claims, 2 Drawing Sheets

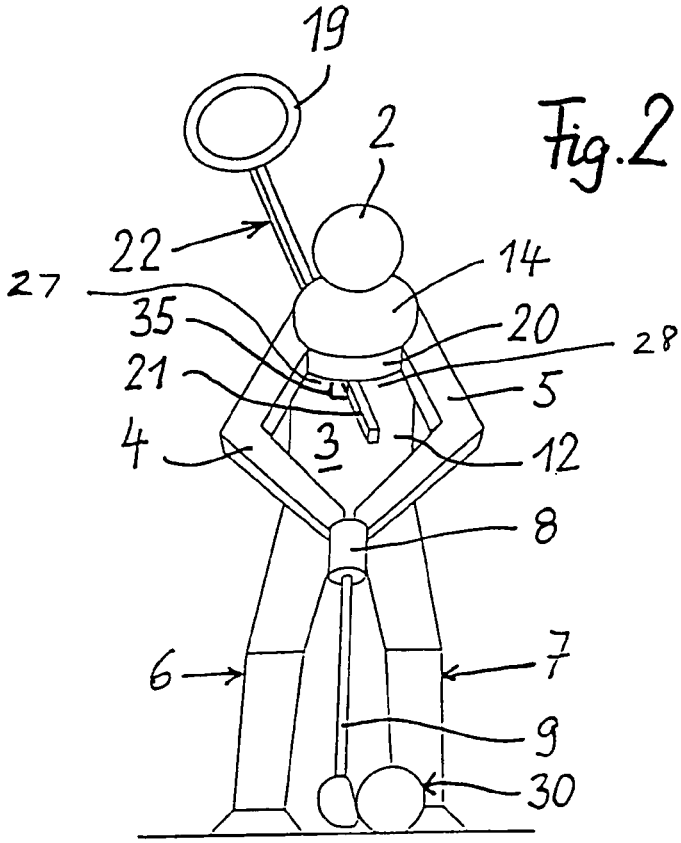
Fig. 2
Fig. 4
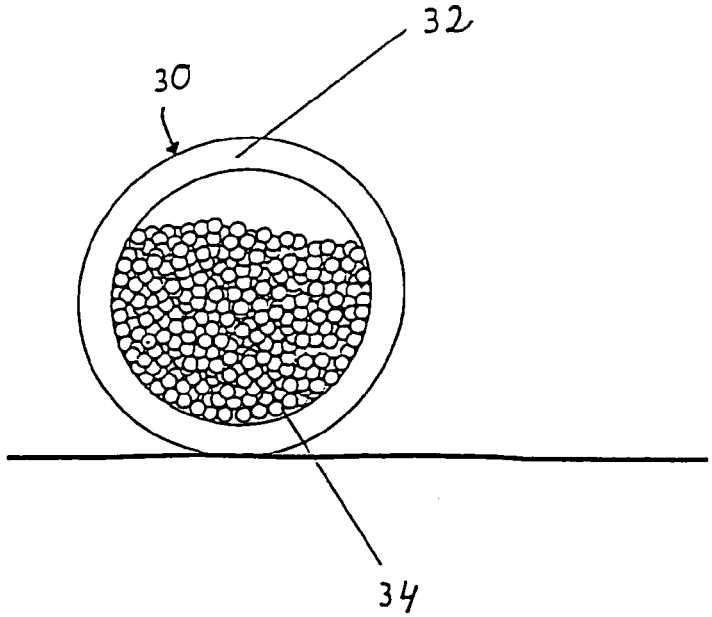

PLAY FIGURE

FIELD OF THE INVENTION

The invention relates to a toy figure in the form of a golf player, with a body comprising a head, torso, arms and legs, and having a recess provided. The arms and the hands are connected with a golf club. The golf club is horizontally swivelable through actuation of an operating pin or handle.

BACKGROUND OF THE INVENTION

A toy figure of the kind mentioned above is known from the document DE 198 07 334 A1, in which the operating pin is guided through a vertical bore passing through the head and which engages into a connecting part of the arms for swiveling of the arms with respect to the torso by means of a u-bent end. By actuating the pin, a swiveling movement of the arm corresponding to the hitting movement of a golf club is supposed to take place.

From the viewpoint of this construction, it is disadvantageous that the transformation of the pressing movement into the swiveling movement of the arms, and consequently of the golf club, requires special additional measures. Further, the appearance of the toy figure is impaired if there is a press pin penetrating through the head.

In the toy figure known from the document WO 92/14523, the downward movement of the press pin is translated into the swiveling movement of the golf club through engagement of a toothed section of the pin with a pinion fixed on the golf club. Disadvantageous in this toy figure is that, here too, the press pin penetrates through the head of the toy figure and that, above all, the golf club cannot meet the golf ball, but rather moves aimlessly since the golf ball is housed in a chamber adjacent the club and is flung immediately and in synchrony with the movement of the club outward from this chamber. The ball chamber is a component that is extraneous to the golf player and is therefore a unsightly accessory to the toy figure.

SUMMARY OF THE INVENTION

Therefore, the task posed by the present invention was to improve the function and the appearance of the abovementioned toy figure. According to the invention, the toy figure is so arranged that the body is subdivided into two parts connected with each other by a circular disk running cross-wise with respect to a center line, whereby a cross-section of the circular disk is inclined to a front side and downward, and includes an operating handle or pin and two arms guided parallel to the cross section, with the circular disk coupled to the arms, and a club receptacle for a shaft of a toy golf club to which the arms bend and extend parallel to the circular disk. As a result, the operating handle or pin can protrude rearwardly from the toy figure, and does not impair its appearance and can be operated freely. Through the orientation of the operating handle or pin, the arms, and further the circular disk, arms and the golf club are arranged parallel to a plane of the section between the lower and upper torso parts. The appearance of the toy figure is not impaired and a simple, direct and linear actuation of the arms is achieved with the golf club. The head of the toy figure does not participate in the operation of the golf club. If the operating handle or pin is uncoupled and is removed from the toy figure, the toy figure, if it is made from a heavy material, for instance, a metal, the toy figure can be used as a paperweight or in other ways, for instance, as a decorative toy figure or for advertising purposes.

Thus, it is an advantage, if a body-sided end of the arms have a toothed disc housed in a segment of the body between the upper and lower torso parts, which can be rotated with the segment. Further, it is useful, if the head and the upper part of the torso, form one piece which is firmly connected with a lower part of the torso by a spigot, which centrically penetrates the toothed disc.

It is possible that the operating handle or pin is firmly connected with the toothed disc. A lateral movement of the operating handle or pin results in direct rotation of the toothed disc, and hence to the hitting movement by the golf club connected to the arms, hitting the toy golf ball. On the other hand, it is especially advantageous, in the sense of simplified actuation, if the operating handle or pin is guided onto the section in a lengthwise displaceable manner, and the toothed disc can turn, driven by the longitudinal movement of the operating handle or pin with respect to a centerline of the toothed disc. This transformation of the longitudinal movement of the operating handle or pin into rotary movement of the toothed disc can be realized in several ways. A simple option is that there is a frictional connection between the operating handle or pin and a periphery of an axial disk appendage, for which purpose, the periphery of the appendage and/or the surface of the operating handle or pin are provided with a material with a high coefficient of friction. Another possible alternative is that the periphery of the axial disk appendage is toothed and is brought into contact with a toothed segment of the operating handle or pin.

Finally, the appendage can be a pinion which interengages with the toothed segment of the operating handle or pin. For a good guidance of the operating handle or pin, it is commendable if an elevation consisting of several studs arranged on the periphery of the section of the lower part with a spacing distance along the peripheral direction and projecting from this section in a direction of an upper part, is provided, on which the operating handle or pin is guided in a longitudinally movable fashion, and between which the appendage or the pinion is arranged. In a preferred embodiment of the invention, the operating handle or pin can be guided in three different directions along the toothed disc, so as to enable rotation of the toothed disc in one or the other direction, and enabling the toy golf ball to be hit to the left or the right. The elevation consists of three studs arranged alternately at equal distances on the periphery of the section of the lower torso part, each one of which has the cross section of a circular segment, whereby a plane, inner circle segment area of each stud serves as a lateral guide for the operating handle or pin. If one of the studs is elevated from the rear segment of the section of the lower torso part, the operating handle or pin can be inserted laterally from the left or the right between the studs and the toothed disc, so that the lateral to and fro movements of the operating handle or pin can swing the arms accordingly.

For a toy figure that hits the toy golf ball in the manner described above, various designs have been attempted that prevent the ball from rolling freely, so that it remains within the limited field of the play and does not roll uncontrollably beyond its boundaries. That is the reason why tabletop soccer balls are given an angular geometric shape that brakes rolling of the balls into an open field. However, an angular ball is not compatible with real practice, which is hitting of only round balls. As a result, according to the invention, an improved toy golf ball, distinguishes itself by the fact that it is comprised of a hollow ball made of plastic, which is filled in part with a pourable mass, for example, sand. In any case, the mass should have a higher specific weight with respect to the plastic material of the ball and should preferably fill only about 70% of the hollow volume of the ball. The higher the specific weight of the pourable mass, the lower is a filling ratio of the ball.

BRIEF DESCRIPTION OF THE DRAWINGS

In the following, the invention is described in detail with the help of a demonstrative embodiment shown in the attached drawings. Shown in the drawings are:

FIG. 2: A front view of the golf player of FIG. 1 with the toy golf ball;

FIG. 4: An axial section through the toy golf ball according to FIG. 2.

DETAILED DESCRIPTION OF THE PREFERRED EMBODIMENTS

Figure 1:
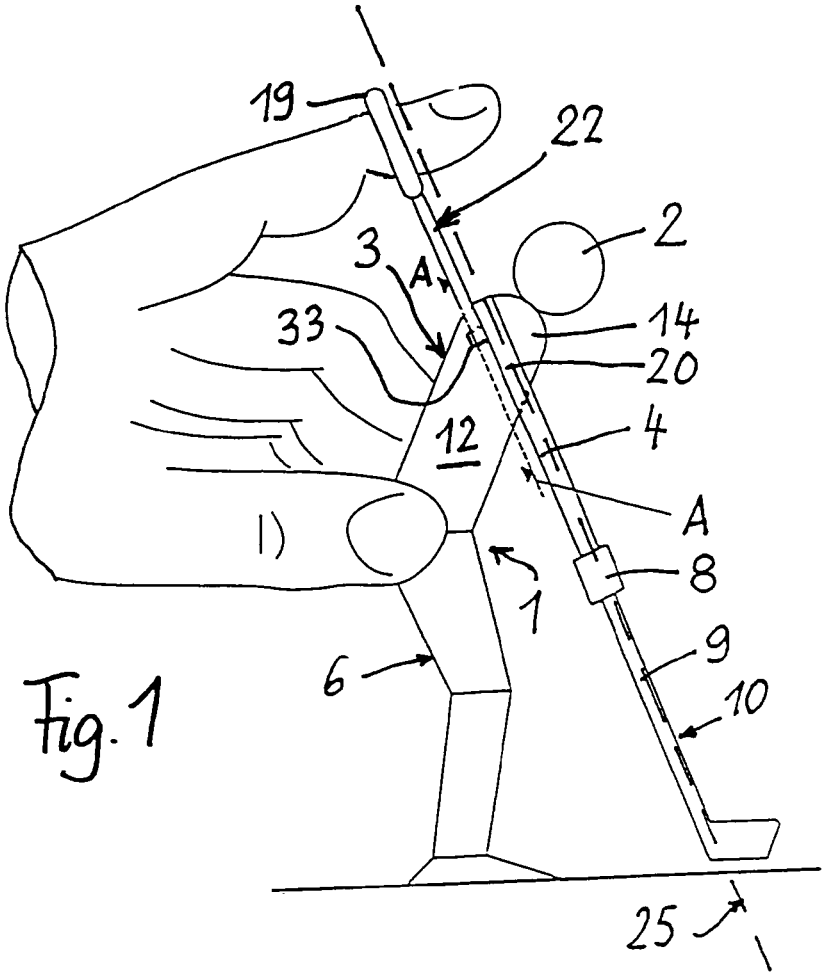
FIG. 1: A schematic side view of a toy figure provided with the features according to the invention in the form of a golf player with golf club and operating hand.

The toy FIG. 1, made from metal, wood or plastic, consists of a head 2, torso 3, arms 4 and 5 and the two legs 6, 7. The connected hands of the arms 4, 5 lead into a box-shaped club receptacle 8 for the shaft 9 of the toy golf club indicated as a whole by 10. The arms 4, 5 are u-bent outward at the elbows, as is typical in the game of golf, and the legs 6, 7 stand spread wide apart, on enlarged feet, for a steady stand on the ground.

The torso 3 is comprised of a large lower part 12, and a smaller upper part 14, connected with the head 2, which can be looked at as a type of shoulder part. The lower part 12 is connected with the upper part 14 only by a spigot 16, visible in part in FIG. 3. The head is anchored firmly in the upper part 14 and is screwed by means of a screw thread part into a corresponding internal screw thread in the lower part 12 in such a way that the upper part 14 is connected undisplaceably with the head 2 at the lower part 12 by the spigot 16. A prespecified distance (segment) defining a recess remains between the upper part 14 and the lower part 12. In particular, a distance is kept between the plane area of the upper part 14 pointing to the lower part 12 and the practically similar plane section 18 of the lower part 12, which allows an essentially circular disk segment 20 to be freely rotatable about the spigot 16 that penetrates the disk segment 20 centrically and, in particular, the disk segment 20 is on and parallel to the plane section 18. The plane section 18 lies crosswise with respect to the centerline of the torso 3 and is inclined toward the front and downward.

The body-sided ends of the arms 4, 5 are included in the disk segment 20 on sides of the disk segment 20, lying practically opposite to each other, so that a rotation of the disk segment 20 brings about a swiveling movement of the arms 4, 5 about the spigot 16. As FIG. 1 shows, the arms 4, 5 extend parallel to the plane section 18. The golf club receptacle 8 has a slide-in jack opening, into which the shaft 9 of the golf club 10 can be slipped so that the shaft 9 also extends parallel to the plane section 18. Therefore, the disk segment 20, the arms 4, 5 and the shaft 9 extend within a designed plane 25 or extend parallel to it. One can recognize that a twist of the disk segment 20 about the spigot 16 in a clockwise or counter-clockwise direction brings about the corresponding clockwise and counter-clockwise hitting movement of the golf club 10.

In an especially simple embodiment of the invention, not displayed here, the rotation of the disk segment 20 in one or the other aforementioned direction can be achieved simply by hand, in that at a rear peripheral segment of the disk segment 20, an operating handle or pin is firmly built, which also extends in the designed plane 25 or parallel to the plane section 18, upwards toward the rear with respect to the toy FIG. 1. A to and from movement of the operating handle parallel to the plane section 18 leads directly to the corresponding movement of the golf club 10.

Considering the circumstance that the hitting movement of the golf club 10 must be executed as fast as possible in order to transport the hit toy golf ball 30 to a distance as far as possible, in the presented embodiment of the invention, a gear mechanism 24 is connected between the operating handle or pin 22 and the disk segment 20, which causes a fast rotation of the disk segment 20 proportionate to a longitudinal movement of the operating handle or pin. In particular, in the displayed embodiment of the invention, a pinion or toothed disc 23 is arranged on a bottom side of the disk segment 20, whose external teeth interengage with longitudinal teeth arranged on a bottom free end segment 21 of the operating handle or pin 22. The pinion 23 has a bore at the center for penetration of the spigot 16. With that, the translatory downward movement, longitudinal to the plane section 18 of the operating handle or pin 22, is transformed into a rapid rotation of the pinion 23 and thus of the disk segment 20, so that translatory movement of the operating handle or pin 22 is transformed into a rotating movement of the disk segment 20 with a higher speed.

In an alternative embodiment, the end segment 21 can also be provided with a coating with a higher coefficient of friction, and instead of the peripheral teeth, the pinion 23 can be equipped with a rubber lining, so that due to the frictional connection taking place between the end segment 21 and the periphery of the pinion 23, the translatory movement of the operating handle or pin 22 is also transformed into a correspondingly transformed rotating movement of the disk segment 20.

Figure 3:
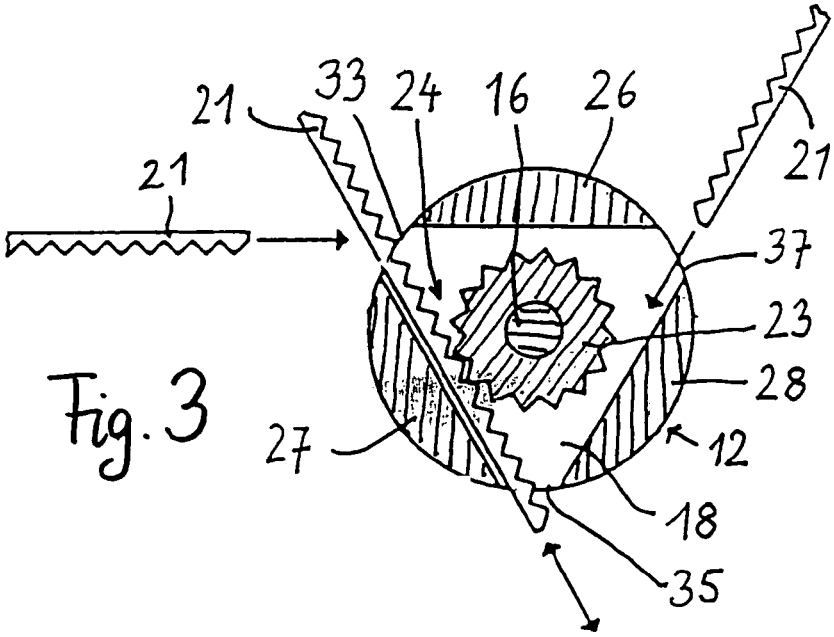
FIG. 3: A schematic enlarged top view of a cross section along the line A-A through the golf player in FIG. 1.

As FIG. 3 in particular shows, three studs 26, 27, 28 project from the plane section 18 at its border, in the direction of the upper part 14 of the torso, whereby a cross section of each of these studs has the form of a circular segment. The studs 26, 27, 28 are arranged on the periphery of the plane section 18 with the same mutual distance and leave an opening 33, 35, 37 free between each of them, through which the end segment 21 of the operating handle or pin 22 can penetrate in three different directions parallel to the plane section 18 and designed plane 25, into a space surrounding the studs 26, 27, 28. Thereby the plane, inner surface of the respective studs serves the purpose as a lateral support for the end segment 21 of the operating handle or pin 22, so that the end segment remains in a reliable grip with the pinion 23. As can be seen in FIG. 3, the operating handle or pin 22 can be pulled out upwards or (in case of horizontally inserted operating handle or pin 22) laterally from the toy FIG. 1. The distance provided between the upper part 14 of the torso and the lower part 12 of the torso is selected such that the studs 26, 27, 28 of the disk segment 20 located between the parts 12, 14, and the pinion 23 allows the end segment 21 to plunge into the gap between the studs.

If the operating handle or pin 22 as in FIGS. 1 and 3 is pressed downward, the pinion 23, and therefore the disk segment 20, rotate counter-clockwise. Between the adjacent vertical studs 26 and 28 remains the opening 37, through which the end segment 21 of the operating handle or pin 22, adjusted accordingly, is inserted and can be brought into contact with the pinion 23. Pressing the operating handle or pin 22 inward into a position corresponding to the end segment 21 leads to a clockwise revolution of the pinion 23. Finally, end segment 21 of the operating handle or pin 22 can also be inserted horizontally through the opening 33 between the studs 26 and 27 and the opposite opening 37 between the studs 26 and 28 into the space bordering the three studs and brought into contact with the pinion 23. The operating handle 22 is then moved to and fro in engagement with the gear mechanism 24 of the pinion 23, which leads to a rotation movement of the pinion 23 in the corresponding direction of rotation. The height, with which the studs 26, 27, 28 project from the plane section 18, is the same in each case and can be dimensioned in such a fashion that the disk segment 20 lies in easily rotatable fashion in the plane of the surfaces of the three studs and the pinion 23 is located within the space bordering the three studs. The bottom area of the upper part 14 thus retains against play of the disk segment 20.

It is obvious, as FIG. 2 shows, that the free bottom end of the end segment 21, can protrude from the breast of the toy FIG. 1 under the disk segment 20, if the operating handle or pin 22 is pressed correspondingly farther downwards. The operating handle or pin 22 has a finger eyelet 19 on its end opposite to the toothed section of the end segment 21, in which, for instance, the front part of the index finger can easily be inserted in order to push the operating handle or pin 22 not only inwards in a downward direction but also from a downside to outwardly, whereby the thumbs and fingers encircle and secure the torso 12 as shown in FIG. 1.

Finally, FIG. 4 shows an axial cross section through the toy golf ball 30, which can be hit sideways by the golf club 10, if the operating handle 22 is actuated correspondingly. The toy golf ball 30 is comprised of a hollow ball made from plastic, which can, for example, be transparent, and is indicated by the reference symbol 32. The hollow ball 30 is filled with a pourable mass 34, which has a significantly higher specific weight compared to that of the material from which the cover of the hollow ball 30 is made. At any rate, this mass can be pourable sand or metal powder. The filling degree of the hollow ball 30 can, as it can be seen in FIG. 4, be up to about 70%, or as in case of balls with a lighter mass, even 50%. If the hollow ball 30 is filled with pourable dry sand, a filling degree of about 50% to 70% is recommended. Consequently, this toy golf ball 30 according to the invention has the feature that a free run out of the toy golf ball 30 is severely refrained, so that an uncontrolled excursion of the ball outside the field of play is forestalled.

The invention claimed is:

1. A toy figure in a form of a golf player, said toy figure comprising a body including a head, a torso, arms and legs, a predetermined separation distance between an upper and a lower part of the torso, a circular disk, said circular disk being located between said upper part and said lower part of the torso in said predetermined separation distance, said upper part and said lower part of said torso being connected to each other, a pinion rotatably mounted in the lower torso part, the pinion being connected to the arms through the circular disk and being associated with an operating mechanism for swivelling the arms, hands formed at the arms being provided with a golf club receptacle for receiving a shaft of a toy golf club, and the pinion and the arms being swivelled parallel to a plane extending downwardly from the torso in front of the legs, an operating pin for rotating the pinion, the operating pin being inserted into the lower torso part through at least one opening provided in the torso and being moved up and down or to the right or to the left for causing a hitting of a golf ball by the toy golf club held by the hands and the operating pin being capable of being entirely withdrawn from the lower torso part.

2. Toy figure according to claim 1, wherein the head and the upper part of the torso are connected to the lower part of the torso by a spigot centrically penetrating the pinion.

3. The toy figure according to claim 1 further comprising a hollow ball of plastic being filled partially with a pourable mass.

4. Toy figure according to claim 3, wherein the mass has a higher specific weight compared to the plastic material of the ball.

5. Toy figure according to claim 4, wherein the mass consists of one of sand, metal and plastic powder.

6. The toy figure according to claim 1, wherein the operating pin is guided at the torso longitudinally and tangentially to the pinion.

7. The toy figure according to claim 6, wherein the operating pin frictionally engages a circumference of an appendage of the pinion when rotating the pinion.

8. The toy figure according to claim 1, wherein the operating pin is moved within or parallel to the plane.

9. The toy figure according to claim 8, wherein a circumference of the pinion is toothed and is engaged by a toothed section of the operating pin when rotating the pinion.

10. The toy figure according to claim 1, wherein a plurality of studs are provided at a periphery of the predetermined separation distance, the operating pin is guided longitudinally by and internally of the studs.

11. The toy figure according to claim 10, wherein each stud has a cross section of a circular segment, a plane surface of each stud forming a lateral guide for the operating pin.

12. The toy figure according to claim 1, wherein the operating pin is guided along a plurality of directions on the pinion.

13. The toy figure according to claim 1, wherein the operating pin is equipped with a handle at a free end thereof.

14. The toy figure according to claim 1, wherein the circular disk is rotatable parallel to a section of the lower part of the torso.

15. The toy figure according to claim 1, wherein an upper surface of the lower part lies crosswise with respect to a centerline of the torso and parallel to the plane.

16. Toy figure in a form of a golf player, said toy figure comprising a body having a head, a torso, arms and legs, a predetermined distance between an upper part and a lower part of the torso, said predetermined distance including a circular disk, the arms include a golf club receptacle, a pinion rotatably mounted in the lower part of the torso and connected with the arms by the circular disk, an operating pin for rotating the circular disk, the operating pin being guided along three different directions on the pinion.

* * * * *